US006135855A

United States Patent [19]

Vanell

[11] Patent Number: 6,135,855

[45] Date of Patent: Oct. 24, 2000

[54] TRANSLATION MECHANISM FOR A CHEMICAL MECHANICAL PLANARIZATION SYSTEM AND METHOD THEREFOR

[75] Inventor: James F. Vanell, Tempe, Ariz.

[73] Assignee: Motorola, Inc., Schaumburg, Ill.

[21] Appl. No.: 09/124,722

[22] Filed: Jul. 30, 1998

[51] Int. Cl.[7] ..... B24B 47/00

[52] U.S. Cl. ..... 451/14; 451/288

[58] Field of Search ..... 451/288, 287, 451/14, 19, 443, 444, 72, 41; 508/100, 101

[56] References Cited

U.S. PATENT DOCUMENTS

| | | | |
|---|---|---|---|
| 2,998,397 | 8/1961 | Riesing | 508/100 |
| 4,604,833 | 8/1986 | Kimura et al. | 451/14 |
| 5,456,627 | 10/1995 | Jackson et al. | 451/57 |
| 5,499,942 | 3/1996 | Pflager | 451/14 |

*Primary Examiner*—Robert A. Rose
*Attorney, Agent, or Firm*—A. Kate Huffman

[57] ABSTRACT

Chemical mechanical planarization (CMP) of semiconductor wafers presents a harsh abrasive and chemical environment for equipment used in a polishing process. Prior art translation mechanisms are prone to failure due to corrosion and require maintenance that exposes the polishing process to contamination from lubricants. A translation mechanism (31) requiring no lubrication is designed to have maintenance at intervals greater than a CMP tool. The translation mechanism (31) includes a housing (32) and a moveable mount (33). The housing (32) and the moveable mount (33) are made of hardened stainless steel which is impervious to the CMP environment. Bearing shafts (39) buffer a threaded shaft (36) from side loading on the moveable mount (33). Polymer bearings (51) connected to moveable mount (33) provide a low friction contact surface to bearing shafts (39). A polymer translation nut (41) connects to the moveable mount (33) and is threaded onto the threaded shaft (36).

15 Claims, 4 Drawing Sheets

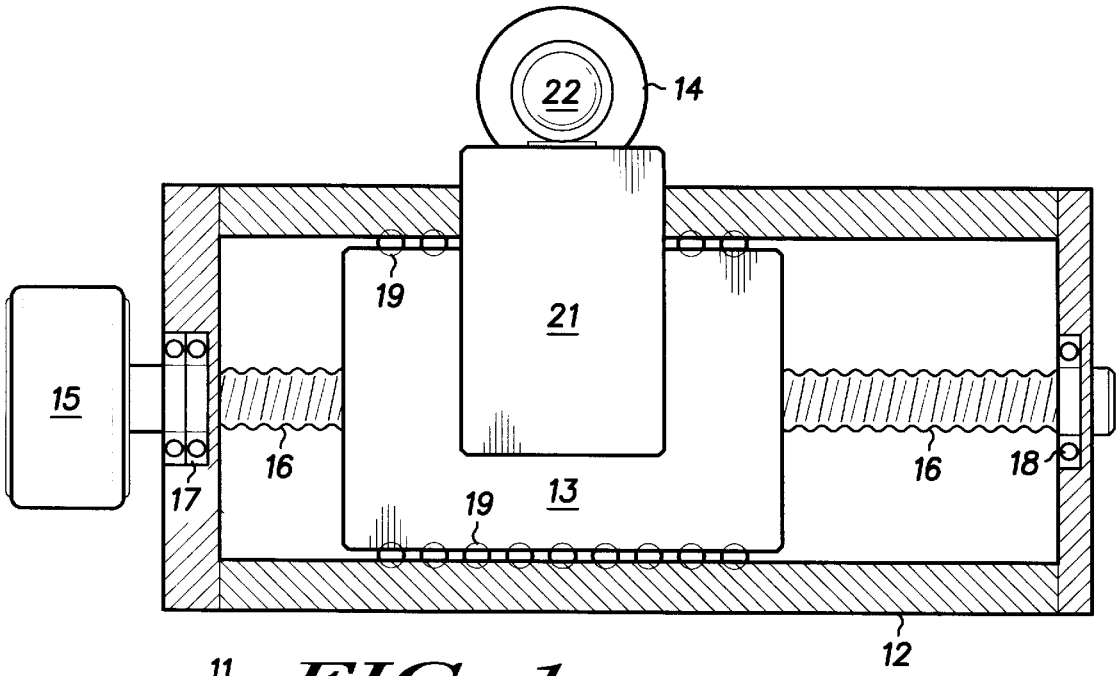
11 FIG. 1
- PRIOR ART -
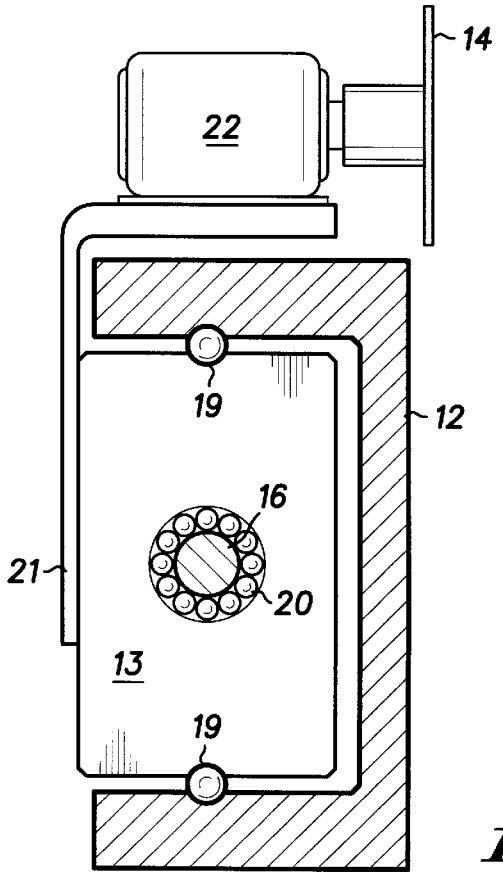
FIG. 2
- PRIOR ART -

TRANSLATION MECHANISM FOR A CHEMICAL MECHANICAL PLANARIZATION SYSTEM AND METHOD THEREFOR

BACKGROUND OF THE INVENTION

The present invention relates, in general, to chemical mechanical planarization (CMP) systems, and more particularly, to a translation mechanism.

In general, chemical mechanical planarization (CMP) is used to remove material or a global film from a processed side of a semiconductor wafer. Ideally, a uniform amount of material is removed across the semiconductor wafer leaving a highly planar surface on which to continue wafer processing. Any non-uniformity in the polishing process may result in a loss of yield or long term device reliability problems. Uniformity is the measure of variation in surface height across a semiconductor wafer. Some common types of chemical mechanical planarization processes in the semiconductor industry are used to remove oxides, polysilicon, tungsten, and copper.

The future of chemical mechanical planarization is challenged by the fact that device/interconnect geometries are decreasing to a level that requires greater control and uniformity of the planarization process, both of which are difficult to achieve. The complexity of the planarization problem is being exacerbated by an increase in wafer diameter. The semiconductor industry is converting from 200 millimeter wafer diameters to 300 millimeter wafer diameters.

One component that has a significant impact on the quality of a chemical mechanical planarization process is a translation mechanism. The translation mechanism is a component of a CMP tool that provides movement or translates an apparatus of a chemical mechanical planarization tool from one area to another. For example, unpolished semiconductor wafers are stored in a predetermined area of a CMP tool. A translation mechanism moves a wafer carrier assembly to pick up an unpolished semiconductor wafer. The translation mechanism moves the wafer carrier assembly and the unpolished semiconductor wafer from the unpolished wafer pickup area to a polishing area of the CMP tool. One common type of wafer carrier arm uses cams to produce accurate movement.

The polishing area of a CMP tool typically includes a platen that provides a support structure for a polishing process. In general, the platen is a round metal disk with a flat surface. The platen is rotated to aid in the polishing process. A polishing media is placed on the platen. One type of polishing media is a polyurethane pad. A polyurethane pad is used as a polishing media because it is compliant and provides for the transport of polishing chemistry to a semiconductor wafer during a polishing process.

The translation mechanism accurately moves an exposed surface of the unpolished semiconductor wafer in contact and coplanar to a surface of the polishing media. The semiconductor wafer contacts the polishing media at a predetermined pressure, which partially determines the rate of material removal. The predetermined pressure applied across the surface of the semiconductor wafer, in part, is controlled by the translation mechanism. Typically, pressure to the semiconductor wafer is applied by a combination of translation mechanism induced pressure and gas pressure from the carrier assembly to the back-side of the semiconductor wafer.

Material is removed from the semiconductor wafer by mechanical abrasion and chemical reaction. After completion of the polishing process, the translation mechanism moves the polished semiconductor wafer to a storage area for polished wafers. The quality of polishing is directly related to the control of movement of the translation mechanism.

Pad conditioning during the CMP process also impacts the polishing uniformity across a semiconductor wafer surface. Typically, the polyurethane pad used as the polishing media has grooves or perforations, which aid in the transport of the polishing chemistry. Over time, semiconductor wafer material and spent polishing chemistry become trapped in the polyurethane pad. Trapped particles in the matrix of the polishing media can scratch or modify the polishing process thereby reducing polishing uniformity or worst case, damaging the wafers beyond use. In either case, overall wafer yields are reduced, increasing the cost of manufacture of integrated circuit.

Pad conditioning abrades, planarizes, and removes trapped particulates in the polishing media. Pad conditioning results in a the physical change in the surface of a polyurethane pad (polishing media) that involves abrading and profiling the uppermost surface of the pad. Typically, pad conditioning is achieved by placing a pad conditioner assembly in proximity to the polishing media. An end effector is a component of a pad conditioner assembly that requires contact with the polishing media. The end effector has an abrasive surface that cleans, roughens, and planarizes the surface of the polishing media. A material such as diamond is often used as the abrasive. Typically, the end effector is mounted to a translation mechanism, which brings the end effector in contact with the polishing media. The translation mechanism moves the end effector across the surface of the polishing media to condition the surface of the polishing media. In an embodiment of a CMP tool, both the pad conditioner and the polishing media rotate to increase the effectiveness of the pad conditioning process. In general, pad conditioning is done as often as possible within the constraints imposed by the wafer throughput of the CMP tool.

Problems with prior art translation mechanisms include expensive machining requirements, susceptibility to corrosion, and high maintenance requirements. These problems increase manufacturing costs and reduce reliability of the process and the resultant products.

Accordingly, it would be advantageous to have a translation mechanism for a chemical mechanical planarization tool that has improved reliability in a manufacturing environment. It would be of further advantage for the translation mechanism to reduce the cost of polishing each semiconductor wafer.

BRIEF DESCRIPTION OF THE DRAWINGS

FIG. 1 is an illustration of a prior art translation mechanism;

FIG. 2 is an end view of the prior art translation mechanism of FIG. 1.

DETAILED DESCRIPTION OF THE DRAWINGS

Figure 3:
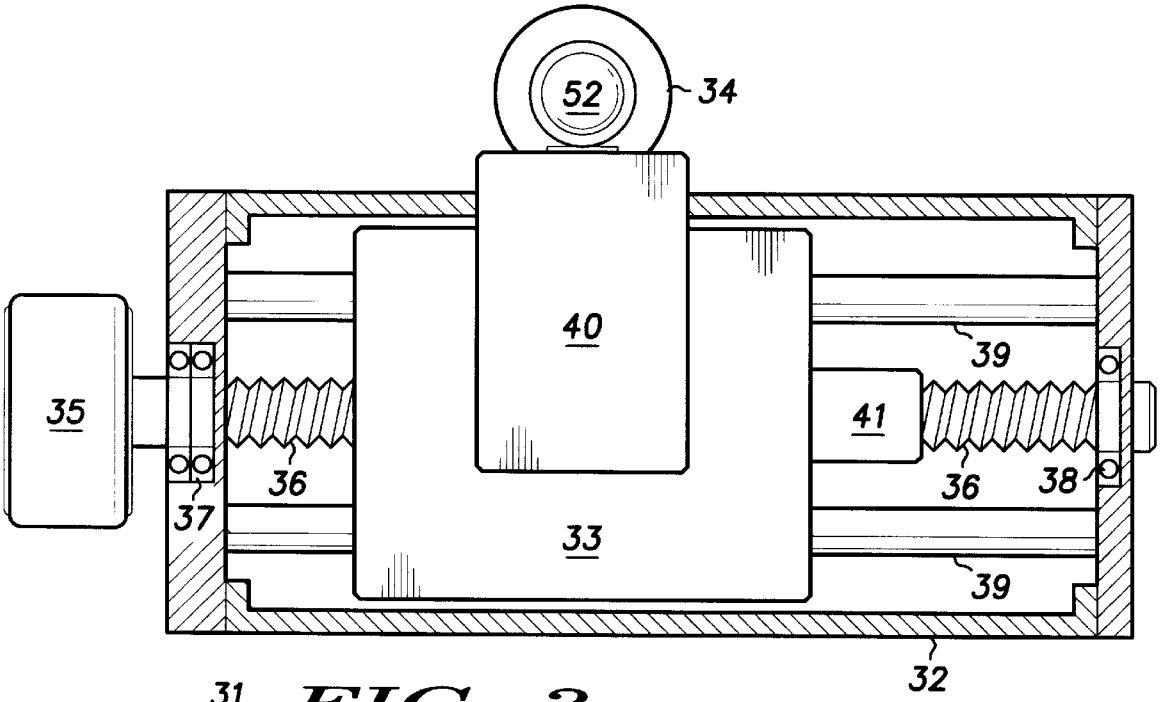
FIG. 3 is an illustration of a translation mechanism in accordance with the present invention.

FIG. 1 is an illustration of a prior art translation mechanism 11. Translation mechanism 11 is commonly used in CMP tools. As an example, translation mechanism 11 is shown having an end effector 14 mounted to a moveable mount 13. Translation mechanism 11 represents a pad conditioning arm of a CMP tool. End effector 14 has an abrasive surface that contacts a polishing media for pad conditioning.

A housing 12 is illustrated having a rectangular shape. Moveable mount 13 moves within housing 12. A motor 15 is mounted near a first end of housing 12. Motor 15 rotates and is connected to a threaded shaft 16. Threaded shaft 16 drives moveable mount 13. Threaded shaft 16 is placed longitudinally in housing 12. A duplex bearing 17 and a radial bearing 18 is respectively mounted in the first end and a second end of housing 12. Duplex bearing 17 and radial bearing 18 fixably attach threaded shaft 16 to housing 12 while allowing it to be rotated by motor 15. Moveable mount 13 is machined having a thread pattern corresponding to threaded shaft 16 and incorporating a recirculating ball bearing (not shown) to reduce friction.

Thrust loads on threaded shaft 16 and moveable mount 13 are managed by the recirculating ball bearings. One half of the race is machined into moveable mount 13 and the other half of the race is machined into threaded shaft 16. Machining moveable mount 13 and threaded shaft 16 to incorporate bearing races is an expensive process. Threaded shaft 16 is threaded through moveable mount 13 such that rotation of threaded shaft 16 moves moveable mount 13 within housing 12. The total distance in which moveable mount 13 can be moved is determined by the distance between the first and second ends.

Without further support, any load or force applied to moveable mount 13 would be transferred to threaded shaft 16. An increase in friction between threaded shaft 16 and moveable mount 13 would result in increased loading on motor 15. Under high side loads, threaded shaft 16 could be bent which thereby damaging translation mechanism 11. Side loading on threaded shaft 16 is prevented by recirculating ball bearings 19 mounted between the moveable mount 13 and either side of housing 12. One half of the race is formed on a side of housing 12 while the other half of the race is formed in the side of moveable mount 13. Machining the side of housing 12 and moveable mount 13 to be bearing races increases the cost of manufacture of translation mechanism 11. Recirculating ball bearings 19 transfers forces on moveable mount 13 to the machined bearing races thereby preventing threaded shafted 16 from being side loaded. Multiple ball bearings distribute the side loads while allowing moveable mount 13 to move freely from the first end to the second end of housing 12 and vice versa.

The working environment of translation mechanism 11 is extremely harsh, being abrasive and either strongly acidic or strongly basic. For example, an aqueous chemistry (polishing chemistry) used to planarize a semiconductor wafer varies from a pH of 1.8 to 12 depending on the type of material being removed from the wafer or work surface. Mechanical abrasives which are a component of the slurry become airborne during the polishing process landing on components of the CMP tool. Housing 12, moveable mount 13, and threaded shaft 16 of translation mechanism 11 comprise a machine hard chrome coating to provide protection. Duplex bearing 17, radial bearing 18, recirculating ball bearings 19, and the recirculating ball bearings incorporated into moveable mount 13 are shielded to minimize contact with the polishing chemistry.

In service, translation mechanism 11 is prone to corrosion, which leads to complete failure of the apparatus. Machine hard chromed material is extremely resistant to wear. Applications such as hydraulic and pneumatic cylinders are well known for using machine hard chrome to protect wear surfaces. Limitations of machine hard chroming include corrosion resistance, adhesion, dimensional uniformity, and environmental concerns. These limitations are emblematic of the problems being seen in CMP tool translation mechanisms. Machine hard chroming is deposited on a steel surface. The chemicals used in the polishing process eventually find a path beneath the machine hard chrome of translation mechanism 11 attacking the underlying metal and causing the hard chrome to peel. The underlying metal is now exposed to moisture and reactive chemicals which eventually lift the chrome from the surface producing flakes, slivers, and blisters. The hard chrome can fall into the slurry affecting polishing uniformity or damaging the semiconductor wafer being polished. The hard chrome flakes can also damage the bearings used in translation mechanism 11 requiring replacement.

Ultimately, translation mechanism 11 corrodes to the point where threaded shaft 16 begins to bind with the corresponding thread pattern and recirculating ball bearings of moveable mount 13. Motor 15 is stressed as the friction increases thereby reducing motor life. Complete failure occurs when threaded shaft 16 will no longer turn due to corrosion. The CMP tool user groups of the semiconductor industry have documented that failure of translation mechanism 11 is one of the worst problems in reducing wafer throughput that the manufacturers face. Upon complete failure, the CMP tool must be shut down and the translation mechanism replaced before wafer processing may begin again. Replacement of translation mechanism 11 is expensive with costs typically exceeding $6,000. Life expectancy of translation mechanism 11 in a CMP tool is on the order of six months when used in wafer production environment. Actively using 10 to 20 CMP tools in a semiconductor plant illustrates the extreme cost in replacement and downtime of the CMP machinery. On average, one or more CMP tools will have to be taken from production each month for repair or replace translation mechanism 11.

Another significant factor in the use of translation mechanism 11 is lubrication. Maintenance must be performed on translation mechanism 11 to ensure consistent performance before corrosion problems occur. Maintenance consists of providing grease to the bearings of translation mechanism 11. Zerk fittings are provided to recirculating ball bearings 19 and the recirculating ball bearings incorporated into moveable mount 13 to simplify lubrication. Typically, duplex bearing 17 and radial bearing 18 are removed and manually greased. When translation mechanism 11 is used for pad conditioning, it is suspended over the area where planarization occurs. Bearing maintenance can contaminate the slurry if grease falls onto the polishing media. Also, grease is released from the bearings as they become damaged due to corrosion from the harsh chemical environment. In addition, the greasing operation and translation mechanism 11 transfer grease throughout a wafer processing facility due to unintentional contact.

FIG. 2 is an end view of the prior art translation mechanism 11 of FIG. 1. The illustration includes housing 12, moveable mount 13, end effector 14, and recirculating ball bearings 19. Recirculating ball bearings 20 in moveable mount 13 are shown in the end view. As mentioned previously, translation mechanism 11 is shown for a pad conditioning application. A bracket 21 is connected to moveable mount 13 for holding a pad conditioning assembly. A motor 22 rotates end effector 14 for abrading and planarizing a pad. Motor 22 is mounted to bracket 21. End effector 14 connects to motor 22.

The end view of translation mechanism 11 illustrates that housing 12 is U-shaped. Either side wall (or both) of housing 12 is machined forming one half of a bearing race for recirculating ball bearings 19. Similarly, movable mount 13 is machined to form the other half of the bearing race for recirculating ball bearings 19. The bearing races and recirculating ball bearings 19 are exposed to the CMP tool environment.

In a pad conditioning application, translation mechanism 11 is mounted above the polishing media of the CMP tool. The polishing surface is placed on a support structure. In an embodiment of a CMP tool, a support structure is a rotating platen. Translation mechanism 11 moves end effector 14 to a position away from the polishing surface during a wafer polishing operation. Translation mechanism 11 moves end effector 14 towards the polishing surface when pad conditioning is required. Translation mechanism 11 is mounted at a height above the polishing surface that ensures end effector 14 will contact the surface of the polishing media during a conditioning operation. Motor 22 rotates end effector 14 during the pad conditioning process. Translation mechanism 11 moves end effector 14 so that the entire area of the polishing surface is conditioned. Polishing chemistry and particulates are thrown off in all directions in both the pad conditioning process and the wafer polishing process. The U-shape of housing 12 is prone to catching and trapping polishing chemistry and particulates. In particular, the polishing chemistry often sprays directly onto recirculating ball bearings 19, recirculating ball bearings 20, and their corresponding races leading to corrosion in these areas.

FIG. 3 is an illustration of a translation mechanism 31. Translation mechanism 31 significantly reduces mechanical failure in the harsh chemical/abrasive atmosphere of a CMP tool under full production conditions. The author found that maintenance of translation mechanism 31 typically extends beyond the periodic maintenance of the CMP tool. Furthermore, the components requiring maintenance are designed to be inexpensive and easily replaced. According to the present invention, translational mechanism 31 provides a lubicationless translation mechanism.

Translation mechanism 31 is illustrated in a pad conditioning application to show how it is designed to survive in a CMP environment. Translation mechanism 31 corresponds to a pad conditioning arm of the CMP tool. Translation mechanism 31 is not limited to pad conditioning applications, but is useful for any process requiring a component to be accurately positioned. For example translation mechanism 31 is used as a wafer carrier arm. Multiple translation mechanisms are required if movement in more than one direction is required.

Translation mechanism 31 comprises a housing 32, a moveable mount 33, a motor 52, an end effector 34, a motor 35, a threaded shaft 36, a duplex bearing 37, a radial bearing 38, bearing shafts 39, a bracket 40, and a translation nut 41. Housing 32 preferably is made from hardened stainless steel. In an embodiment of translation mechanism 31, housing 32 is made of 17-4 pH condition 900 stainless steel. Stainless steel of this type is highly resistant to the chemicals and abrasives currently used in the chemical mechanical planarization of semiconductor wafers.

Housing 32 comprises a bottom plate, two side plates, a first end plate, and a second end plate. In an embodiment of housing 32, the bottom plate and the two side plates are machined from the same piece of stainless steel. The first and second end plates attach with screws at opposite ends of housing 32 to the bottom plate and side plate. Preferably, the end plates are precision fit to the housing 32 sides and bottom and accurately locate the axes of the bearing shafts 36, radial bearing 38, and duplex bearing 37 such that they are parallel and coincident with the axes of the respective holes in the moveable mount 33. This dramatically eases multiple alignments during assembly.

For a pad conditioning application, housing 32 has enough travel to move an end effector across a polishing media and return it to a position where it is out of the way of equipment used in a polishing operation. For example, housing 32 has a length of approximately 40 centimeters to provide sufficient travel for the pad conditioning of pads used for 150 and 200 millimeter wafers. The length and width of the bottom plate is approximately 40 centimeters by 7 centimeters. The height and length of the two side plates is approximately 2 centimeters by 40 centimeters. The height and width of the first and second end plates are 4.5 centimeters by 7 centimeters.

Moveable mount 33 is a support structure for holding a component requiring movement. In the example using translation mechanism 31 for the pad conditioning of pads for 150 or 200 millimeter wafers, moveable mount 33 preferably is rectangular in shape. In one embodiment, moveable mount 33 is machined from a single piece of stainless steel. The height, width, and length of moveable mount 33 is approximately 2 centimeters (h) by 6 centimeters (w) by 9 centimeters (l).

In an embodiment of translation mechanism 31, a bracket 40 is connected to moveable mount 33. Bracket 40 is used as a mount for an apparatus. In the pad conditioning application, a motor (shown in FIGS. 3 and 4) is fastened to bracket 40 for rotating end effector 34. End effector 34 is rotated by the motor and placed in contact with a pad of a CMP tool. End effector 34 has an abrasive surface that abrades and cleans the surface of the pad to a planar condition. The force between the pad and end effector 34 is transferred to moveable mount 33. Translation mechanism 31 is designed to support loading to moveable mount 33 and allow moveable mount 33 to translate freely without binding.

Bearing shafts 39 support moveable mount 33 to prevent side loading on threaded shaft 36 and motor 35. Bearing shafts 39 connect to a first end and a second end of housing 32 corresponding to the direction of movement of moveable mount 33. For example, moveable mount 33 moves from the first end to the second end of housing 32 and vice versa. Bearing shafts 39 are placed parallel to one another. In an embodiment of translation mechanism 31, bearing shafts 39 are made of 17-4 pH conditioned 900 stainless steel.

Preferably, bearing shafts 39 are cylindrical in shape having a polished surface to minimize friction and bearing wear, but other shapes may be used. In the example using translation mechanism 31 for the pad conditioning of pads for 150 or 200 millimeters wafers, bearing shafts 39 are approximately 1.25 centimeters in diameter. Bearing shafts 39 of this diameter will not bend or deform unacceptably under maximum loading when pad conditioning. The number and size of bearing shafts (or the thickness of a bearing shaft) can be increased or decreased depending on the force being applied to moveable mount 33.

In an embodiment of translation mechanism 31, bearing shafts 39 are connected to the first and second end plates of housing 32 by a clamping mechanism. An opening is formed in the end plates for each bearing shaft. The clamping mechanism is created by slotting the end plates to each opening. A screw provides the clamping force by pulling the slotted area together thereby reducing the diameter of the opening. The clamp connects each bearing shaft to a corresponding end plate of housing 32. Conversely, the grip on a bearing shaft is reduced by loosening the clamping mechanism (opening the slot) which greatly simplifies disassembly of translation mechanism 31. For example, removal of the second end plate of housing 32 merely comprises the steps of disconnecting threaded shaft 36 from radial bearing 38, loosening the clamping mechanisms holding bearing shafts 39, and removing bolts holding the second end plate to the remaining portion of housing 32. The second end is pulled off exposing moveable mount 33 for maintenance of the polymer bearings and translation nut 41.

Preferably, bearing shaft 39 has a contact surface that is resistant to the harsh CMP environment, that provides a low friction surface, that is low cost, and that has minimal water absorption. Such a contact surface is a polymer bearing.

Preferably, the polymer bearings are connected to moveable mount 33. The polymer bearing provides a low friction surface that allows moveable mount 33 to easily slide between the first and second end plates of housing 32. A force applied to moveable mount 33 is distributed across the surface area of the polymer bearing contacting a corresponding bearing shaft. The surface area of the polymer bearing is made sufficient to withstand forces applied to moveable mount 33 without wearing or deforming unacceptably. The low friction surface reduces the power needed to turn threaded shaft 36 to move moveable mount 33 thereby reducing the size and cost of motor 35.

Examples of materials suitable for the polymer bearings are polytetrafluoroethylene (PTFE), polyimide, polyimide with PTFE, polyvinylidenefluoride, polyamide-polyimide, polyethylene, filled PTFE, and polypropylene. These polymer bearing materials are impervious to the harsh chemical and physical environment of a chemical mechanical planarization process. These materials also have very low coefficients of static and dynamic friction. In an aqueous CMP environment the polymer bearings have minimal dimensional change due to water absorption. Furthermore, the polymer bearings are low-cost wear elements that are easily and quickly replaced resulting in lower maintenance cost and reduced down time.

In an embodiment of translation mechanism 31, openings are formed through moveable mount 33. The diameter of an opening is larger than the diameter of a bearing shaft. Each bearing shaft is placed through a corresponding opening in moveable mount 33. Bearing shafts 39 do not contact moveable mount 33. At least one polymer bearing is placed in an opening of moveable mount 33 contacting the corresponding bearing shaft. The polymer bearings are pressed or threaded into the opening for easy removal. Placing bearing shafts 39 through moveable mount 33 allows the height of translation mechanism 31 to be reduced substantially (low profile).

When rotated, threaded shaft 36 puts a force on moveable mount 33 that produces movement. Threaded shaft 36 runs parallel to bearing shafts 39. Threaded shaft 36 is connected to housing 32 by duplex bearing 37 and radial bearing 38. Threaded shaft 36 is formed from stainless steel or a polymer material. In an embodiment of translation mechanism 31, threaded shaft 36 is formed from stainless steel and coated with a fluoro-polymer to reduce friction on translation nut 41. Duplex bearing 37 and radial bearing 38 are respectively mounted in the first and second end plates of housing 32 which allows threaded shaft 36 to rotate. Motor 35 is connected to threaded shaft 36 near the first end plate of housing 32. In an embodiment of translation mechanism 31, duplex bearing 37 and radial bearing 38 are locational clearance fit or clamped in an opening formed in the first and second end of housing 32.

Preferably duplex bearing 37 comprises two bearings mounted in a single housing. The two bearings (duplexed for reversing thrust loads) handle the thrust loads as well as the radial load at the end of housing 32 where motor 35 is located. Radial bearing 38 comprises a single bearing. Both duplex bearing 37 and radial bearing 38 are sealed and do not require re-lubrication in service which minimizes exposure to chemicals and abrasives in a CMP process. Preferably the phenolic carriers in duplex bearing 37 and radial bearing 38 are vacuum or pressure impregnated with a fluoro-lubricant. The lubricant is released from the phenolic carrier to the bearing on a molecular level, which reduces the possibility of contaminating the CMP process. The fluoro-lubricant is impervious to harsh slurry chemistries and is filtered to prevent the addition of particles to the CMP process.

Translation nut 41 has a thread pattern corresponding to the thread pattern of threaded shaft 36. Translation nut 41 is threaded onto threaded shaft 36 and connected to moveable mount 33. As threaded shaft 36 is rotated it imparts a thrust force on translation nut 41 which moves moveable mount 33. An example of materials suitable for translation nut 41 are polytetrafluoroethylene (PTFE), polyimide, polyimide with PTFE, polyvinylidenefluoride, polyamide-polyimide, polyethylene, filled PTFE, and polypropylene.

In an embodiment of translation mechanism 31, an opening is formed through the length of moveable mount 33 to accommodate threaded shaft 36. The diameter of the opening is larger than a diameter of threaded shaft 36. Threaded shaft 36 does not contact moveable mount 33. An example of connecting translation nut 41 to moveable mount 33 is by forming an external thread pattern on translation nut 41. The opening in moveable mount 33 has a corresponding thread pattern. Translation nut 41 is securely fastened to moveable mount 33 by threading into the opening. Alternately, translation nut could be press fit into the opening. In either example, translation nut 41 is easily and quickly removed for maintenance as it is a wear element of translation mechanism 31.

Figure 4:
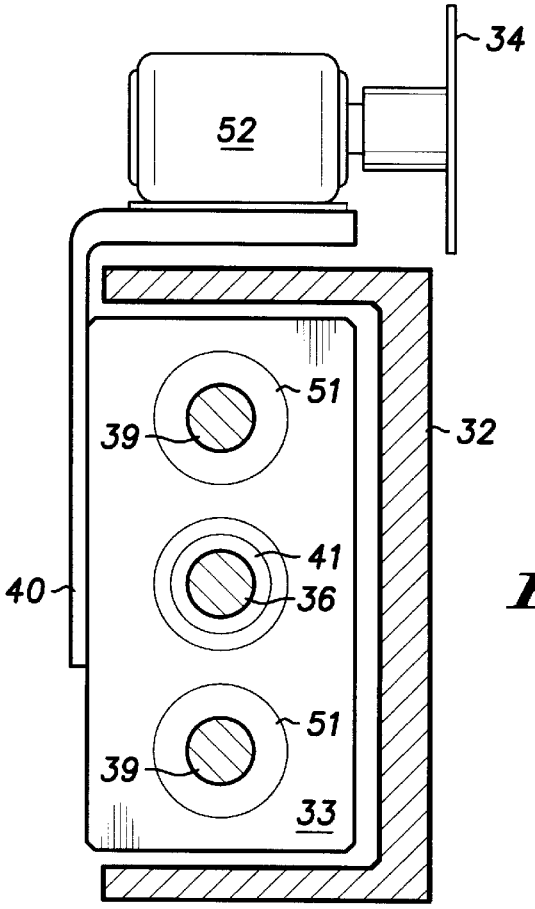
FIG. 4 is an end view of the translation mechanism of FIG. 3 showing the moveable mount.

FIG. 4 is an end view of translation mechanism 31 of FIG. 3 showing moveable mount 33. The illustration of translation mechanism 31 includes housing 32, moveable mount 33, threaded shaft 36, bearing shafts 39, translation nut 41, bracket 40, and end effector 34. Translation mechanism 31 further includes a motor 52 and polymer bearings 51. Note that any force placed on end effector 34 is transferred through bracket 40 to moveable mount 33. Bearing shafts 39 and polymer bearings 51 absorb the side loading on moveable mount 33 allowing threaded shaft 36 to spin freely without binding.

Three openings are formed through moveable mount 33. The openings are parallel to one another. Threaded shaft 36 is located centrally through moveable mount 33. Bearing shafts 39 are placed through moveable mount 33 on either side of threaded shaft 36. Polymer bearings 51 are press fit into openings in moveable mount 33. The inner diameter of polymer bearings 51 are designed to be slightly larger than the diameter of bearing shafts 39 when press fit. Press fitting securely holds polymer bearings 51 into moveable mount 33. Translation nut 41 has an external thread pattern and threads into the corresponding opening into moveable mount 33. Threading ensures that translation nut 41 will stay fastened to moveable mount 33 as rotational force on threaded shaft 36 places a force on translation nut 41 to move moveable mount 33. Placing bearing shafts 39 and threaded shaft 36 through moveable mount 33 allows translation mechanism 31 to have a low profile.

Figure 5:
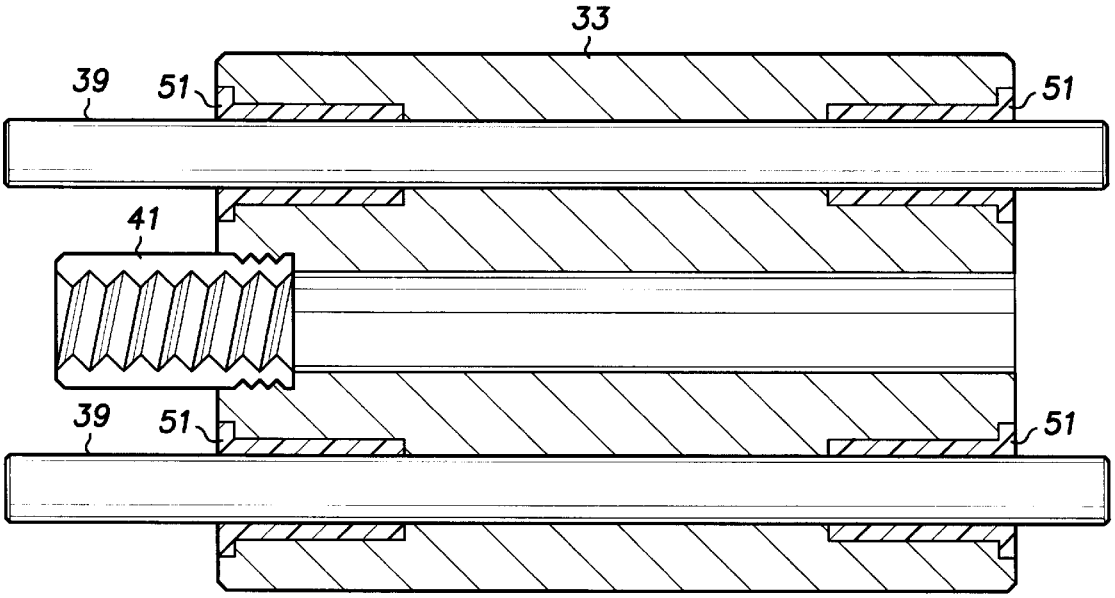
FIG. 5 is a cross-sectional view of the moveable mount of FIG. 3.

FIG. 5 is a cross-sectional view of moveable mount 33 of FIG. 3. The illustration includes moveable mount 33, bearing shafts 39, translation nut 41, and polymer bearings 51. Translation nut 41 includes inner and outer threads. The outer threads securely fasten translation nut 41 to moveable mount 33.

In an embodiment of moveable mount 33 four polymer bearings are used, two per bearing shaft. The length of a polymer bearing is determined by the maximum loading on moveable mount 33. In this example, the maximum loading is divided by four (number of polymer bearings used) and is a function of the contact area of a polymer bearing. The contact area is selected for bearing longevity and low friction. In a pad conditioning application for chemical mechanical planarization of a semiconductor wafer each polymer bearing has a length of approximately 1.9 centimeters.

Figure 6:
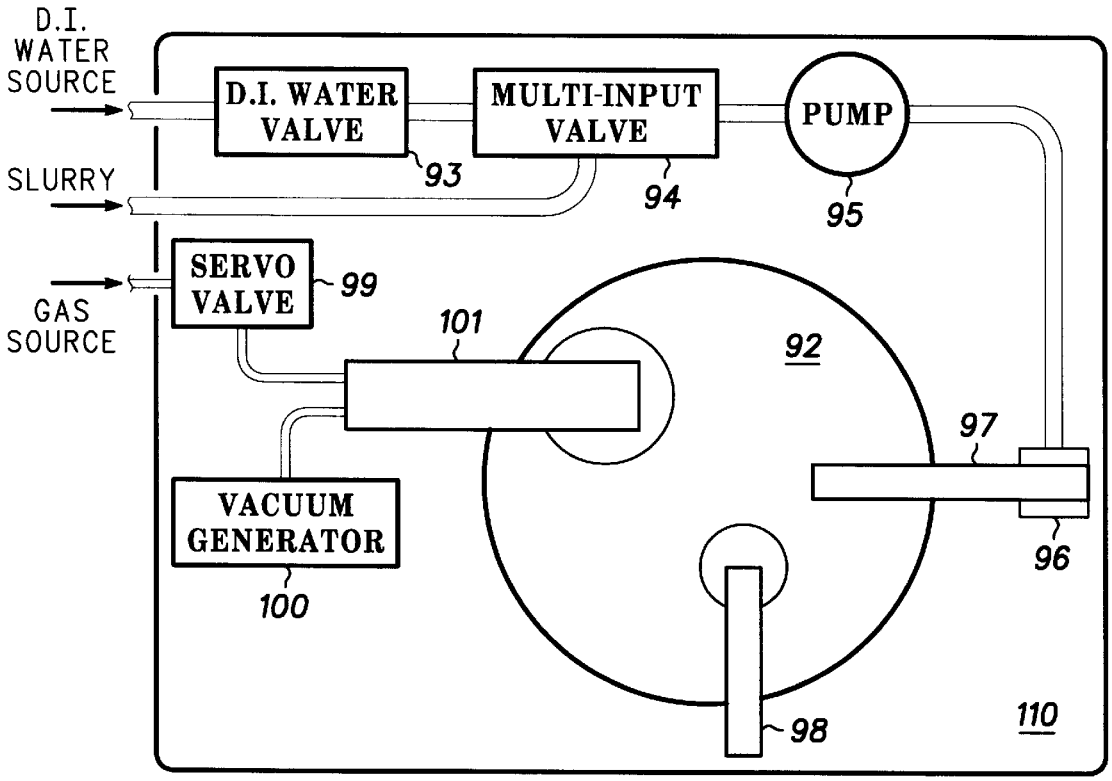
FIG. 6 is a top view of a chemical mechanical planarization (CMP) tool in accordance with the present invention.

FIG. 6 is a top view of a CMP tool 91 in accordance with the present invention. CMP tool 91 comprises a platen 92, a deionized (DI) water valve 93, a multi-input valve 94, a pump 95, a dispense bar manifold 96, a dispense bar 97, a conditioning arm 98, a servo valve 99, a vacuum generator 100, and a wafer carrier arm 101. Conditioning arm 98 and wafer carrier arm 101 include the translation mechanism described hereinabove (FIG. 3) to respectively move an end effector and wafer carrier within CMP tool 91.

Platen 92 supports various polishing media and chemicals used to planarize a processed side of a semiconductor wafer. Platen 92 is typically made of metal such as aluminum or stainless steel. A motor (not shown) couples to platen 92. Platen 92 is capable of rotary, orbital, or linear motion at user-selectable surface speeds.

Deionized water valve 93 has an input and an output. The input is coupled to a DI water source. Control circuitry (not shown) enables or disables DI water valve 93. DI water is provided to multi-input valve 94 when DI water valve 93 is enabled. Multi-input valve 94 allows different materials to be pumped to dispense bar 97. An example of the types of materials that are input to multi-input valve 94 are chemicals, slurry, and deionized water. In an embodiment of CMP tool 91, multi-input valve 94 has a first input coupled to the output of DI water valve 93, a second input coupled to a slurry source, and an output. Control circuitry (not shown) disables all the inputs of multi-input valve 94 or enables any combination of valves to produce a flow of selected material to the output of multi-input valve 94.

Pump 95 pumps material received from multi-input valve 94 to dispense bar 97. The rate of pumping provided by pump 95 is user-selectable. Minimizing flow rate variation over time and differing conditions permits the flow to be adjusted near the minimum required flow rate, which reduces waste of chemicals, slurry, or DI water. Pump 95 has an input coupled to the output of multi-input valve 94 and an output.

Dispense bar manifold 96 allows chemicals, slurry, or DI water to be routed to dispense bar 97. Dispense bar manifold 96 has an input coupled to the output of pump 95 and an output. An alternate approach utilizes a pump for each material being provided to dispense bar 97. For example, chemicals, slurry, and DI water each have a pump that couples to dispense bar manifold 96. The use of multiple pumps allows the different materials to be precisely dispensed in different combinations by controlling the flow rate of each material by its corresponding pump. Dispense bar 97 distributes chemicals, slurry, or DI water onto a polishing media surface. Dispense bar 97 has at least one orifice for dispensing material onto the polishing media surface. Dispense bar 97 is suspended above and extends over platen 92 to ensure material is distributed over the majority of the surface of the polishing media.

Wafer carrier arm 101 suspends a semiconductor wafer over the polishing media surface. Wafer carrier arm 101 applies a user-selectable down force onto the polishing media surface. In general, wafer carrier arm 101 is capable of rotary motion as well as a linear motion. A semiconductor wafer is held onto a wafer carrier by vacuum. Wafer carrier arm 101 has a first input and a second input.

Vacuum generator 100 is a vacuum source for wafer carrier arm 101. Vacuum generator 100 generates and controls vacuum used for wafer pickup by the wafer carrier. Vacuum generator 100 is not required if a vacuum source is available from the manufacturing facility. Vacuum generator 100 has a port coupled to the first input of wafer carrier arm 101. Servo valve 99 provides a gas to wafer carrier arm 101 for wafer ejection after the planarization is complete. The gas is also used to put pressure on the backside of a wafer during planarization to control the wafer profile. In an embodiment of CMP tool 91, the gas is nitrogen. Servo valve 99 has an input coupled to a nitrogen source and an output coupled to the second input of wafer carrier arm 101.

Conditioning arm 98 is used to apply an abrasive end effector onto a surface of the polishing media. The abrasive end effector planarizes the polishing media surface and cleans and roughens the surface to aid in chemical transport. Conditioning arm 98 typically is capable of both rotational and translational motion. The pressure or down force in which the end effector presses onto the surface of the of the polishing media is controlled by conditioning arm 98.

Figure 7:
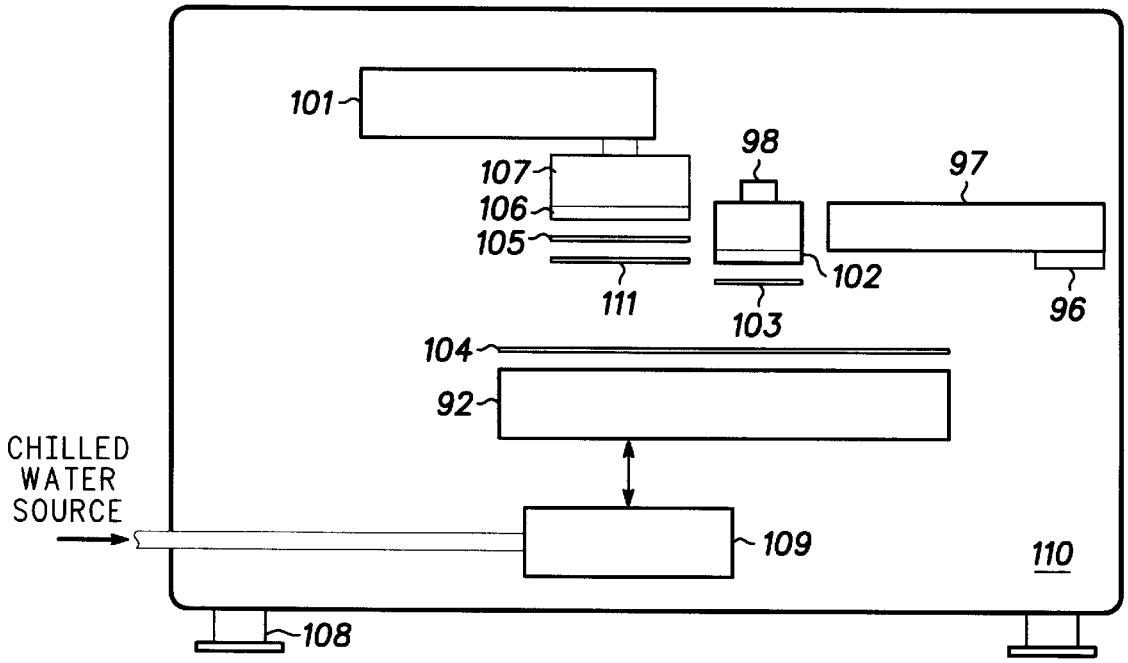
FIG. 7 is a side view of the CMP tool shown in FIG. 6.

FIG. 7 is a side view of the chemical mechanical planarization (CMP) tool 91 shown in FIG. 6. As shown in FIG. 7, conditioning arm 98 includes a pad conditioner coupling 102 and an end effector 103. CMP tool 91 further includes a polishing media 104, a carrier assembly 107, machine mounts 108, a heat exchanger 109, an enclosure 110, and a semiconductor wafer 111.

Polishing media 104 is placed on platen 92. Typically, polishing media 104 is attached to platen 92 using a pressure sensitive adhesive. Polishing media 104 provides a suitable surface upon which to introduce a polishing chemistry. Polishing media 104 provides for chemical transport and micro-compliance for both global and local wafer surface regularities. Typically, polishing media 104 is a polyurethane pad, which is compliant and includes small perforations or annular groves throughout the exposed surface for chemical transport.

Carrier assembly 107 couples to wafer carrier arm 101. Carrier assembly 107 provides a foundation with which to rotate semiconductor wafer 111 in relation to platen 92. Carrier assembly 107 also puts a downward force on semiconductor wafer 111 to hold it against polishing media 104.

A motor (not shown) allows user controlled rotation of carrier assembly 107. Carrier assembly 107 comprises a first assembly and a second assembly. The second assembly inclines freely in relation to the first assembly for providing angular compensation. Carrier assembly 107 includes vacuum and gas pathways to hold semiconductor wafer 111 during planarization, profile semiconductor wafer 111, and eject semiconductor wafer 111 after planarization.

A carrier film 105 and a carrier ring 106 is shown in the illustration of carrier assembly 107. Carrier ring 106 aligns semiconductor wafer 111 concentrically to the second assembly and physically constrains semiconductor wafer 111 from moving laterally. Carrier film 105 provides a surface for semiconductor wafer 111 with suitable frictional characteristics to prevent rotation due to slippage in relation to carrier assembly 107 during planarization. In addition, carrier film 105 is slightly compliant as an aid to the planarization process.

Pad conditioner coupling 102 couples to conditioning arm 98. Pad conditioner coupling 102 allows angular compliance between platen 92 and end effector 103. End effector 103 abrades polishing media 104 to achieve flatness and aid in chemical transport to the surface of semiconductor wafer 111 being planarized.

Chemical reactions are sensitive to temperature. It is well known that the rate of reaction typically increases with temperature. In CMP processing, the temperature of the planarization process is held within a certain range to control the rate of reaction. The temperature is controlled by heat exchanger 109. Heat exchanger 109 is coupled to platen 92 for both heating and cooling. For example, when first starting a wafer lot for planarization the temperature is approximately room temperature. Heat exchanger 109 heats platen 92 such that the CMP process is above a predetermined minimum temperature to ensure a minimum chemical reaction rate occurs. Typically, heat exchanger 109 uses ethylene glycol as the temperature transport/control mechanism to heat or cool platen 92. Running successive wafers through a chemical mechanical planarization process produces heat, for example, carrier assembly 107 retains heat. Elevating the temperature at which the CMP process occurs increases the rate of chemical reaction. Cooling platen 92 via heat exchanger 109 ensures that the CMP process is below a predetermined maximum temperature such that a maximum reaction is not exceeded.

Machine mounts 108 raise chemical mechanical planarization tool 91 above floor level to allow floor mounted drip pans where they are not integral to the polishing tool. Machine mounts 108 also have an adjustable feature to level CMP tool 91 and are designed to absorb or isolate vibrations.

Chemical mechanical planarization tool 91 is housed in an enclosure 110. As stated previously, the CMP process uses corrosive materials harmful to humans and the environment. Enclosure 110 prevents the escape of particulates and chemical vapors. All moving elements of CMP tool 91 are housed within enclosure 110 to prevent injury.

Operation of chemical mechanical planarization tool 91 is described hereinbelow. No specific order of steps is meant or implied in the operating description as they are determined by a large extent to the type of semiconductor wafer polishing being implemented. Heat exchanger 109 heats platen 92 to a predetermined temperature to ensure chemicals in the slurry have a minimum reaction rate when starting a chemical mechanical planarization process. A motor drives platen 92 which puts polishing media 104 in one of rotational, orbital, or linear motion.

Wafer carrier arm 101 moves to pick up semiconductor wafer 111 located at a predetermined position. The vacuum generator is enabled to provide vacuum to carrier assembly 107. Carrier assembly 107 is aligned to semiconductor wafer 111 and moved such that a surface of carrier assembly contacts the unprocessed side of semiconductor wafer 111. Carrier film 105 is attached to the surface of carrier assembly 107. Both the vacuum and carrier film 105 hold semiconductor wafer 111 to the surface of carrier assembly 107. Carrier ring 106 constrains semiconductor wafer 111 centrally on the surface of carrier assembly 107.

Multi-input valve 94 is enabled to provide slurry to pump 95. Pump 95 provides the slurry to dispense bar manifold 96. The slurry flows through dispense bar manifold 96 to dispense bar 97 where it is delivered to the surface of polishing media 104. Periodically, deionized water valve 93 is opened to provide water through dispense bar 97 to displace the slurry to prevent it from drying, settling, or agglomerating in dispense bar 97. The motion of platen 92 aids in distributing the polishing chemistry throughout the surface of polishing media 104. Typically, slurry is delivered at a constant rate throughout the polishing process.

Wafer carrier arm 101 then returns to a position over polishing media 104. Wafer carrier arm 101 places semiconductor wafer 111 in contact with polishing media 104. Carrier assembly 107 provides angular compensation thereby placing the surface of semiconductor wafer 111 coplanar to the surface of polishing media 104.

Polishing chemistry covers polishing media 104. Wafer carrier arm 101 puts down force on semiconductor wafer 111 to promote friction between the slurry and semiconductor wafer 111. Polishing media 104 is designed for chemical transport which allows chemicals of the slurry to flow under semiconductor wafer 111 even though it is being pressed against the polishing media. As heat builds up in the system, heat exchanger 109 changes from heating platen 92 to cooling platen 92 to control the rate of chemical reaction.

It should be noted that it was previously stated that platen 92 is placed in motion in relation to semiconductor wafer 111 for mechanical polishing. Conversely, platen 92 could be in a fixed position and carrier assembly 107 could be placed in rotational, orbital, or translational motion. In general, both platen 92 and carrier assembly 107 are both in motion to aid in mechanical planarization.

Wafer carrier arm 101 lifts carrier assembly 107 from polishing media 104 after the chemical mechanical planarization process is completed. Wafer carrier arm 101 moves semiconductor wafer 111 to a predetermined area for cleaning. Wafer carrier arm 101 then moves semiconductor wafer 111 to a position for unloading. Vacuum generator 100 is then disabled and servo valve 99 is opened providing gas to carrier assembly 107 to eject semiconductor wafer 111.

Uniformity of the chemical mechanical planarization process is maintained by periodically conditioning polishing media 104, which is typically referred to as pad conditioning. Pad conditioning promotes the removal of slurry and particulates that build up and become embedded in polishing media 104. Pad conditioning also planarizes the surface and roughens the nap of polishing media 104 to promote chemical transport. Pad conditioning is achieved by conditioning arm 98. Conditioning arm 98 moves end effector 103 into contact with polishing media 104. End effector 103 has a surface coated with industrial diamonds or some other abrasive which conditions polishing media 104. Pad conditioner coupling 102 is between conditioning arm 98 and end effector 103 to allow angular compliance between platen 92 and end effector 103. Conditioning arm 98 is capable of rotary and translational motion to aid in pad conditioning. Pad conditioning is done during a planarization process, between wafer starts, and to condition a new pad prior to wafer processing.

By now it should be appreciated that a translation mechanism for a CMP system and a method for using has been disclosed. The translation mechanism is used in a conditioning arm or wafer carrier arm to provide movement for an apparatus. Scheduled maintenance on the translation mechanism is extended past that of the CMP tool and all failure mechanisms of prior art designs have been significantly reduced. Components of the translation mechanism are made from materials impervious to the abrasive and acidic/basic environment encountered in a semiconductor wafer to prevent corrosion and abrasive wear. Lubrication is eliminated from the translation mechanism which reduces maintenance and prevents contamination of the polishing chemistry. Wear elements of the translation mechanism are isolated to two components, polymer bearings and a polymer translation nut. The moveable mount of the translation mechanism is designed to expose the wear elements to allow easy access for rapid removal and replacement during regular scheduled maintenance of the CMP tool. The wear elements are also designed to be very inexpensive to reduce operating costs of the translation mechanism. For example, replacement of the wear elements per translation mechanism is less than 20 dollars over a 1 to 2 year maintenance time period.

What is claimed is:

1. A translation mechanism for a CMP system comprising:

a housing a threaded shaft rotatably coupled to said housing;

a moveable mount;

a polymer translation nut threaded to said threaded shaft and coupled to said moveable mount;

a plurality of polymer bearings coupled to said moveable mount; and a plurality of bearing shafts coupled to said housing wherein each bearing shaft of said plurality of bearing shafts is coupled through a corresponding polymer bearing of said plurality of polymer bearings and wherein said plurality of bearing shafts are parallel to said threaded shaft.

2. The translation mechanism of claim 1 wherein said housing, said threaded shaft, and said moveable mount are formed from a stainless steel.

3. The translation mechanism of claim 1 wherein said threaded shaft is coated with a fluoro-polymer.

4. The translation mechanism of claim 1 wherein said threaded shaft is made from a harder material than said polymer translation nut.

5. The translation mechanism of claim 1 wherein an opening is formed through said moveable mount and wherein said threaded shaft is coupled through said opening of said moveable mount.

6. The translation mechanism of claim 5 wherein said polymer translation nut is press fit into said opening thereby fastening said polymer translation nut to said moveable mount.

7. The translation mechanism of claim 5 wherein said polymer translation nut is threaded into said opening thereby fastening said polymer translation nut to said moveable mount.

8. The translation mechanism of claim 1 wherein said plurality of bearing shafts are formed from stainless steel.

9. The translation mechanism of claim 1 wherein said threaded shaft is rotatably coupled to said housing via radial bearings having an impregnated lubricant source.

10. A chemical mechanical planarization tool for polishing a semiconductor wafer comprising:

a dispense bar for providing materials used in a polishing process;

a platen for supporting the semiconductor wafer;

a wafer carrier arm;

a wafer carrier assembly coupled to said wafer carrier arm for holding said semiconductor wafer;

a conditioning arm; and an end effector coupled to said conditioning arm, said end effector for abrading a surface of polishing media wherein a lubricationless translation mechanism is used in said wafer carrier arm or said conditioning arm, the lubricationless translation mechanism comprising (a) a housing, (b) a threaded shaft rotatably coupled to said housing, (c) a moveable mount, (d) a polymer translation nut threaded to said threaded shaft and coupled to said moveable mount, (e) a plurality of polymer bearings coupled to said moveable mount, and (f) a plurality of bearing shafts coupled to said housing wherein each bearing shaft of said plurality of bearing shafts couples through a corresponding polymer bearing of said plurality of polymer bearings and wherein said plurality of bearing shafts are parallel to said threaded shaft.

11. The chemical mechanical planarization tool of claim 10 further including a pad conditioner coupling coupled between said conditioning arm and said end effector to bring said end effector in angular compliance with said polishing media.

12. The chemical mechanical planarization tool of claim 10 wherein said plurality of polymer bearings and said polymer translation nut are formed from a group of polymers consisting of polytetrafluoroethylene, polyimide, a combination of polytetrafluoroethylene and polyimide, polyamide-imide, polyethylene, and filled polytetrafluoroethylene.

13. The chemical mechanical planarization tool of claim 10 wherein said threaded shaft is rotatably coupled to said housing via radial and duplex thrust bearings having an impregnated lubricant source.

14. The chemical mechanical planarization tool of claim 13 wherein said radial and duplex thrust bearings have a polymer race that is vacuum impregnated with lubricant.

15. The chemical mechanical planarization tool of claim 13 wherein said radial and duplex thrust bearings have a polymer race that is pressure impregnated with lubricant.

* * * * *